US005920156A

United States Patent [19]

Carson et al.

[11] Patent Number: 5,920,156

[45] Date of Patent: Jul. 6, 1999

[54] MULTIPLE CHANNEL, MULTIPLE SCENE DIMMING SYSTEM WITH MULTIPLE INDEPENDENT REMOTE DIMMERS

[75] Inventors: Steven R. Carson, Lucas; Robert Anthony Floyd, Garland, both of Tex.

[73] Assignee: The Genlyte Group Incorporated, Secaucus, N.J.

[21] Appl. No.: 08/854,436

[22] Filed: May 12, 1997

Related U.S. Application Data

[62] Division of application No. 08/431,689, Apr. 28, 1995, Pat. No. 5,646,490.

[51] Int. Cl.[6] ..... H05B 37/02

[52] U.S. Cl. ..... 315/317; 315/292; 315/318

[58] Field of Search ..... 315/301, 316, 315/317, 312, 318, 291, 292; 340/825, 825.06, 825.52, 825.53; 250/214 D

[56] References Cited

U.S. PATENT DOCUMENTS 4,158,132 6/1979 O'Dell ..... 250/205

*Primary Examiner*—Don Wong
*Assistant Examiner*—David H. Vu
*Attorney, Agent, or Firm*—Dennis T. Griggs

[57] ABSTRACT

A lighting control and dimming system utilizes a single traveler conductor for transmitting analog data signals corresponding to a particular light intensity level of multiple dimmers in a dimmer group. A predetermined binary data word is retrieved from the read-only memory of a remote controller and is transmitted serially in an analog pulse train over the traveler conductor to each dimmer unit. Each dimmer unit includes a microcontroller and read-only memory in which a group of binary numbers are stored. The analog data signal received by each dimmer is converted to binary and is compared bit-by-bit with each binary number stored in the dimmer memory. A serial bit comparator produces an enable signal in response to a bit-by-bit identity match between the converted analog data signal and the preset binary number stored in the dimmer ROM. Dimmers enabled by the transmitted analog data signal produce a predetermined scene at a particular brightness level corresponding with one of the stored binary numbers. The remote dimmers are decoupled from a master controller by a high impedance input circuit.

9 Claims, 7 Drawing Sheets

MULTIPLE CHANNEL, MULTIPLE SCENE DIMMING SYSTEM WITH MULTIPLE INDEPENDENT REMOTE DIMMERS

CROSS REFERENCE TO RELATED APPLICATION

This is a divisional of application Ser. No. 08/431,689 filed Apr. 28, 1995, now U.S. Pat. No. 5,646,490.

FIELD OF THE INVENTION

This invention relates generally to lighting controllers, and in particular to light dimming systems.

BACKGROUND OF THE INVENTION

Light dimming systems are used to control multiple lighting circuits which may be widely separated from each other by a substantial distance, for example in a restaurant, a large meeting hall or in a theater. The lighting circuits are connected to power dimmers so that the intensity of the lights can be controlled collectively, individually or in groups whereby a variety of different combinations of lighting levels may be selected for achieving different lighting effects (scenes).

Typically, each light or group of lights is selectively controlled through a power dimmer, which is in turn connected to an individual controller or operator switch. In such a system, separate sets of wires run from a central controller to each light or group of lights. Sometimes, dimmers are included along with wall-mounted toggle switches for controlling the level of power supplied to each of the lighting circuits. Such dimmers usually take the form of rheostats which are manually set to the desired level of brightness. Consequently, even for small installations, a large amount of wiring is necessary to connect all of the lights with their respective power dimmers, and to connect the power dimmers to their respective controllers.

DESCRIPTION OF THE PRIOR ART

Conventional lighting control and dimming systems provide a main switch control station and one or more remote dimming stations which provide independent ON/OFF operation and dimming control. Such systems utilize three-way and four-way dimmer switches in combination with one or more traveler wires to provide independent ON/OFF dimming operation at each remote location. In a typical installation in which a single overhead light is controlled and dimmed from a main station and a remote station, a manual, two-way dimmer switch is installed in a wall box at the main switch station, and a manual, two-way dimmer switch is installed in a wall box at the remote switch station. One side of the lamp load is connected to the power source neutral conductor and the other side of the lamp load is connected by a load conductor to the main station switch. A hot conductor connects the hot supply line to the remote dimmer switch. The main dimmer switch and remote dimmer switch are further interconnected by an auxiliary power distribution conductor, commonly referred to as a traveler conductor, a hot line conductor and a ground safety conductor. In this two-way switching and dimming arrangement, the lamp load is wired in the conventional "switched hot" configuration.

Some remote dimmer switches have been connected to a master dimmer controller in such installations, but have required two or more additional conductors and a remote power supply for providing logic high and logic low control signals to the master switch control circuit when the lighting load is turned on. In a retrofit installation in which the main power switch and remote switch are to be replaced, it is desirable to remove the switches at each switch station and install a main dimmer controller in the main station wall box and a remote dimmer in each remote station wall box. Moreover, it is desirable to connect the remote dimmer switches to the main dimmer switch control circuit by utilizing only the existing traveler conductor and ground safety conductor which interconnect the main and remote wall box switch stations. In new wiring installations, a single conductor (e.g. traveler conductor) interconnection of remote dimmer stations with the master dimming controller is also desirable for the purpose of simplifying the wiring interconnections and for reducing wiring installation costs.

In domestic and commercial installations, two-phase power is supplied, with phase A power being applied to one group of electrical loads, and phase B power being applied to another load group. Consequently, in a large area lighting installation, some of the lighting loads will be supplied by phase A power, and other lighting loads will be supplied by phase B power. Dimming typically utilize semiconductor switching devices whose duty cycle is controlled with reference to the phase of the current waveform. Because of the phase difference, it is difficult to utilize conventional light dimming systems which employ a microprocessor controlled memory unit for selectively controlling the application of power to a specific group of lighting loads, individual ones of which may be separately energized by phase A and phase B power.

OBJECTS OF THE INVENTION

It is a general object of the present invention to provide a light dimming system in which the amount of wiring used to connect a controller to multiple power dimmers is substantially reduced.

Another object of the present invention is to provide a lighting control and dimming system having a single conductor from which several individually-dimming lighting loads can be controlled without appreciably increasing the amount of wiring.

Another object of the present invention is to provide an improved light dimming system in which multiple scenes can be stored and selected manually at a master control station and at each dimmer station.

Yet another object of the present invention is to provide a lighting control and dimming system which can send and receive dimmer station address signals from a remote controller or a master controller independently of line phase per dimmer station or controller station.

SUMMARY OF THE INVENTION

The foregoing objects are achieved by a lighting control and dimming system which utilizes a single conductor, for example the traveler conductor, for transmitting analog data signals to each dimmer of the light/dimmer group. The master controller includes a signal generator for generating a unique and predetermined analog data signal corresponding to a predetermined lighting intensity level for a particular scene. The predetermined analog data signals are stored within a read-only memory of a microcontroller in the master controller and are transmitted serially over the traveler conductor to each dimmer unit. Each dimmer unit includes a microcontroller and read-only memory in which corresponding binary numbers are stored.

In response to operator selection of a predetermined scene, the microcontroller selects from memory the corresponding binary data signal and transmits it serially as an analog data signal over the traveler conductor to an input shift register in each dimmer. The data content of the input shift register is compared, bit-by-bit, with the binary number stored in the dimmer ROM. A serial bit comparator produces an enable signal in response to a bit-by-bit identity match between the transmitted analog data signal and a binary preset number stored in the dimmer ROM. Only a match between the transmitted analog data signal and a binary number stored in the ROM will produce a predetermined scene. After being enabled, the dimmer can be manually adjusted to a new intensity setting, as desired.

The remote signalling and selection of a specific scene is made independently of phase by sampling the logic value of the remote input analog data signal immediately following a logic 1 to logic 0 transition of a zero cross signal. If the high to low transition occurs at any time during which the zero crossing signal is low, logic 1 is loaded into each dimmer remote input shift register. If no high-to-low transition occurs during that period, that particular bit of the remote input shift register is cleared to logic 0. Each time the zero crossing signal returns to logic high, the contents of each dimmer remote input register are shifted, and the contents of each input register are compared bit-by-bit to the contents of a binary number which is stored in the read-only memory of each dimmer microcontroller. A particular dimmer is enabled in response to a match between the analog remote signal and a binary number stored in the dimmer memory.

Operational features and advantages of the present invention will be further understood upon consideration of the following detailed description of the invention taken with reference to the accompanying drawings.

DETAILED DESCRIPTION OF THE PREFERRED EMBODIMENT

Figure 1:
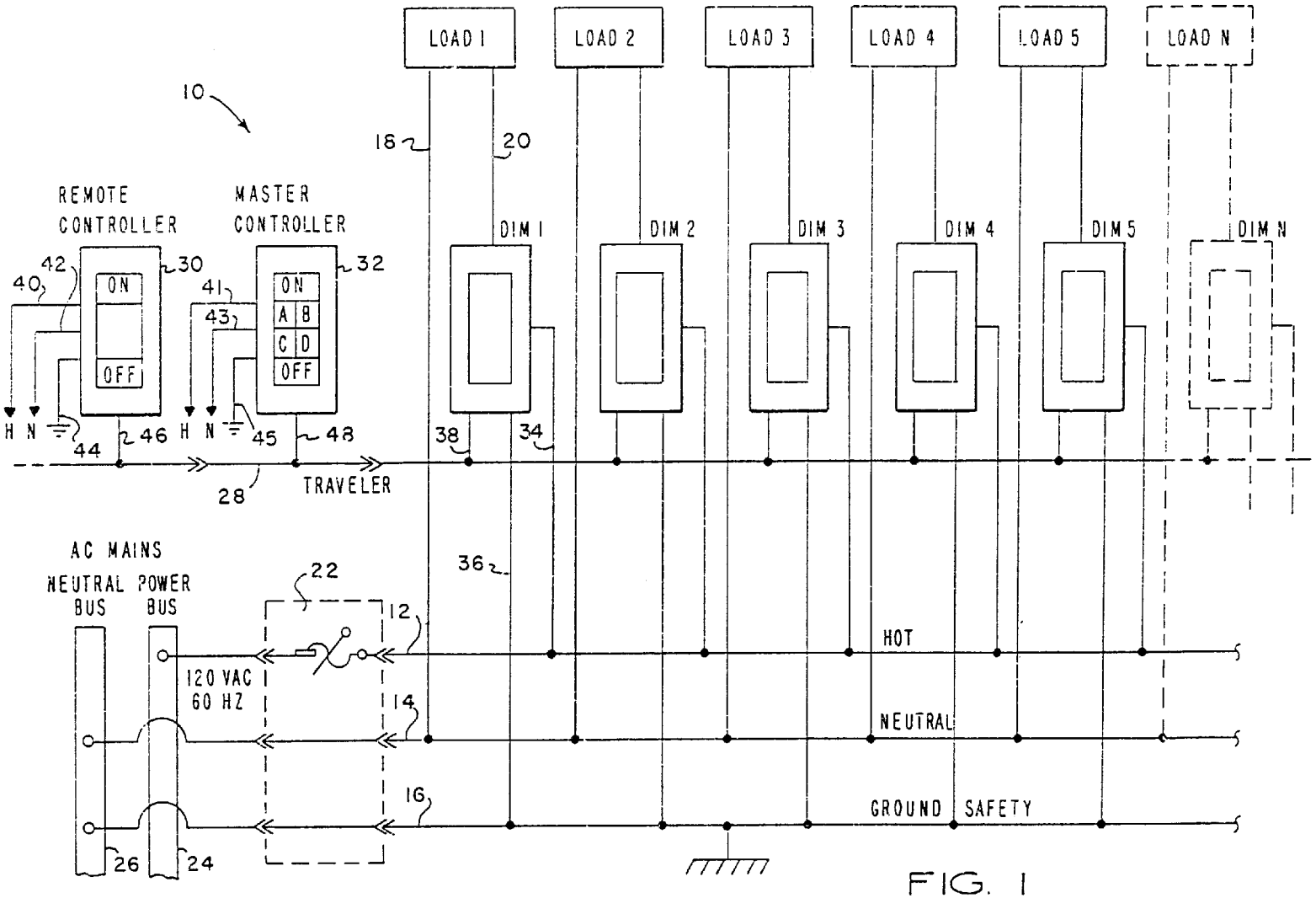
FIG. 1 is a block schematic diagram of a multichannel, multiple scene lighting and dimming circuit.

Referring now to FIG. 1, the lighting control system 10 of the present invention will be described with reference to the hot, neutral and ground safety power conductors 12, 14 and 16, respectively, of a 120 VAC, 60 Hz single phase AC power source which supplies operating power to multiple lighting loads LOAD 1, LOAD 2, . . . , LOAD N. According to conventional AC wiring practice, one terminal of a lighting load, for example LOAD 1, is connected to the neutral supply conductor 14 by a load conductor 18, and the other terminal of LOAD 1 is connected to the switched terminal of a dimmer switch DIM 1 by a load conductor 20. Preferably, the dimmer switch DIM 1 is, in part, a programmable dimmer as described and claimed in U.S. Pat. No. 4,733,138 and 5,194,858 which are assigned to the assignee of the present invention, and is incorporated herein by reference.

Operating power is conducted through a thermal circuit breaker 22 which connects the conductor 12 and an AC power bus 24. Load current is returned through the neutral conductor 14 to a neutral bus 26. According to conventional practice, the ground safety conductor 16 is also electrically connected to the AC neutral bus and is extended in parallel with the hot conductor 12 along the distribution path for safety purposes. At least the hot conductor 12 and the ground safety conductor 16 will be available at each dimmer station. A traveler conductor 28 will be available in addition to the hot and ground safety conductors between the dimming stations.

The lighting control system 10 includes a remote controller 30 and a master controller 32. In a typical system, number of dimmer switches which may be coupled to the master controller 32 is limited to approximately 24 channels because of fan-out loading, since the dimmers draw operating current in the standby operating mode.

Figure 2:
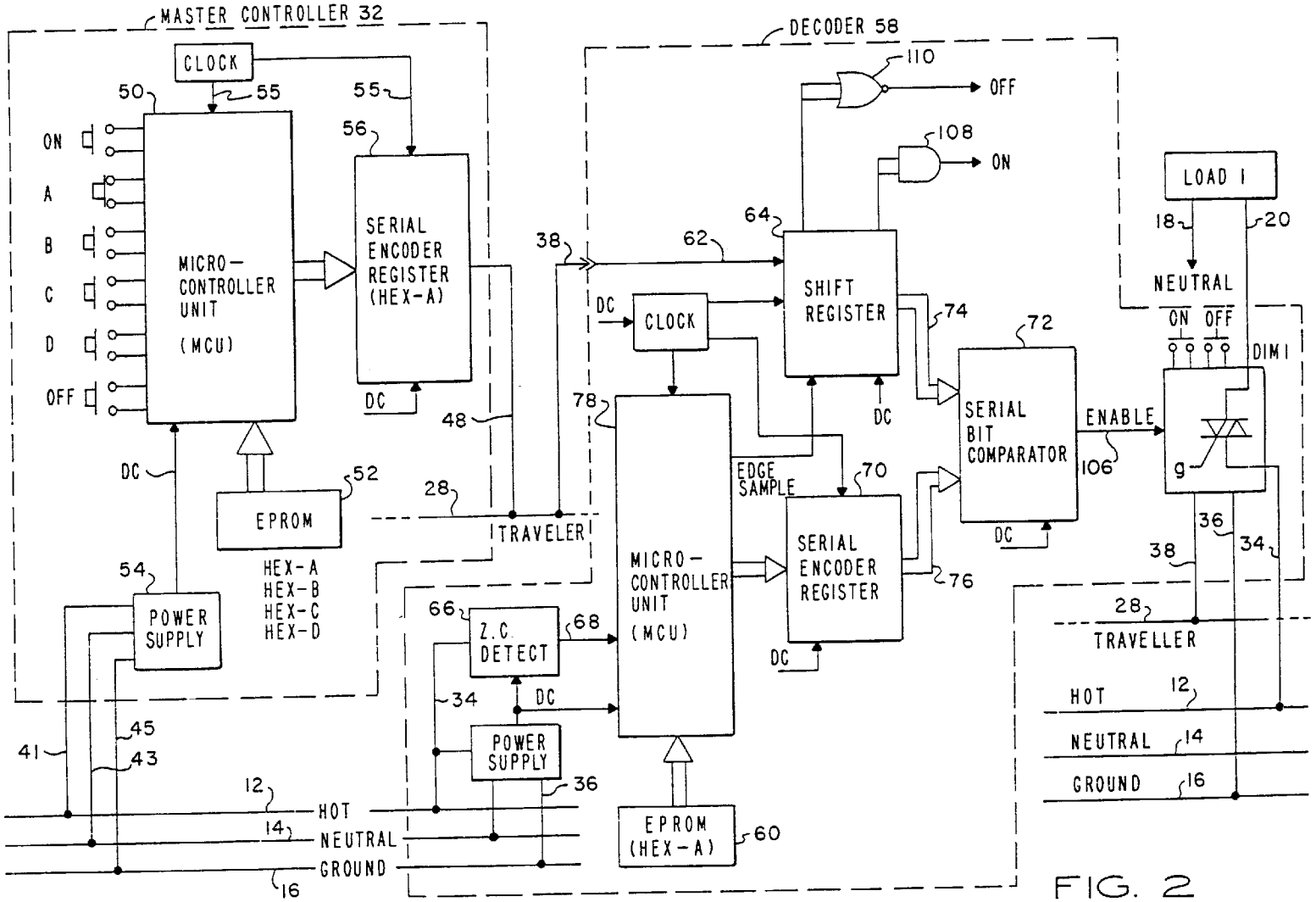
FIG. 2 is a block schematic diagram of the master controller shown in FIG. 1 and one dimmer.

Referring now to FIG. 1 and FIG. 2, the dimmer switches DIM 1, DIM 2, . . . , DIM N have identical circuit construction. The dimmer switch DIM 1 has a first power input conductor 34 connected to the hot power conductor 12 and a second power input conductor 36 connected to the ground safety conductor 16. The dimmer switch DIM 1 also includes a signal input conductor 38 which is electrically connected to the traveler conductor 28 which leads from the remote controller 30 and master controller 32 to each dimmer unit. The remote controller 30 includes input power conductors 40, 42, 44 electrically connected to the hot, neutral and ground conductors 12, 14, 16, respectively, and a signal output conductor 46 which is electrically connected to the traveler conductor 28. The traveler conductor 28 is electrically connected to a remote signal output node 48 of the master controller unit 32. The master controller 32 has input power conductors 41, 43 and 45 electrically connected to the hot, neutral and ground safety conductors 12, 14 and 16, respectively.

It will be appreciated that the dimmer switch stations DIM 1, DIM 2, DIM 3, . . . , DIM N are typically widely separated with respect to each other, and with respect to the remote controller 30 and the master controller 32. Thus, at each dimming station, and each controller at least the hot conductor 12, the ground safety conductor 16 and the traveler conductor 28 are available for interconnection but only the traveler conductor 28 is required to be a common physical conductor in each unit for sending and receiving control signals independently of the line phase of power supplying each dimmer or controller.

Consequently, the dimmers, master controller and remote controller are wire-for-wire interchangeable with conventional two-way manual power switches. Each dimmer switch, the master controller and remote controller include manually operable, momentary contact switches designated ON and OFF, respectively. According to this arrangement, independent ON/OFF manual switch operation is provided at each controller and dimmer station.

Referring now to FIG. 2, a master controller 32 is shown that is capable of storing four scenes, corresponding with four separate intensity levels (A, B, C, D), in addition to ON and OFF conditions and is connected in communication with one of the dimmer units DIM 1 via the traveler conductor 28 in the same manner as each of the other dimmer units of the system may be connected. The controller includes a microcontroller 50, a read-only memory 52, a power supply 54 and a serial encoder register 56. These components are arranged in the form of an information storage and retrieval system making possible the ability to store a predetermined number of scenes and to perform all the necessary control functions. The microcontroller 50 may be any one of several conventional microcontrollers which are commercially available. The type of microcontroller used is largely dependent upon the capacity desired, and is designed so that a variety of logical and arithmetic operations may be performed on or between two accumulation registers including additions, subtractions, logical AND'S, OR'S, compares, compliments, tests and shifts. Dedicated registers (not shown) are used in the control of the system, and include a program counter, an index register, a stack pointer and a condition code register. These are generally controlled by the microcontroller logic, although they may be used or altered under program control.

The microcontroller 50 includes a read-only memory 52 which includes an operating program. The operating program allows user programs and data to be stored in the read-only memory, the working registers to be examined and the execution of the user program to be supervised. Preferably, the read-only memory 52 is an electrically programmable read-only memory (EPROM).

The master controlled 32 includes an ON switch, an OFF switch and four pre-set scene switches labeled A, B, C and D. All of these switches are single pole, single throw, non-latching push-button switches. The depression of each of the switches grounds a voltage available from a local power supply 54 and provides the microcontroller 50 with a logical "zero" input. The microcontroller 50 recognizes the logical zero as a signal that the switch has been depressed. Other configurations of the switches are possible, being important only that the switch have an operative and a non-operative position in order to provide logic signals to the microcontroller. The ON switch provides a fade "up" function when it is depressed and held. Likewise, the OFF switch provides a fade "down" switch which is operative when it is depressed and held in the closed position. The switches A, B, C and D correspond with four predetermined hexadecimal numbers, HEX-A, HEX-B, HEX-C and HEX-D which are stored in the read-only memory 52.

The operating program of the microcontroller 50 addresses the various input switches and determines the status of each switch. When a preset switch is depressed, its status is logic low, and the operating program of the microcontroller issues a command which retrieves the corresponding HEX-coded signal from the read-only memory and inputs the HEX-coded signal to the serial encoder register 56. In the example shown in FIG. 2, preset switch A is depressed, with HEX signal HEX-A being retrieved and input into the serial encoder register 56. The analog data signal corresponding with HEX-A is transmitted to the traveler conductor 28 through an output conductor 48.

Figure 5:
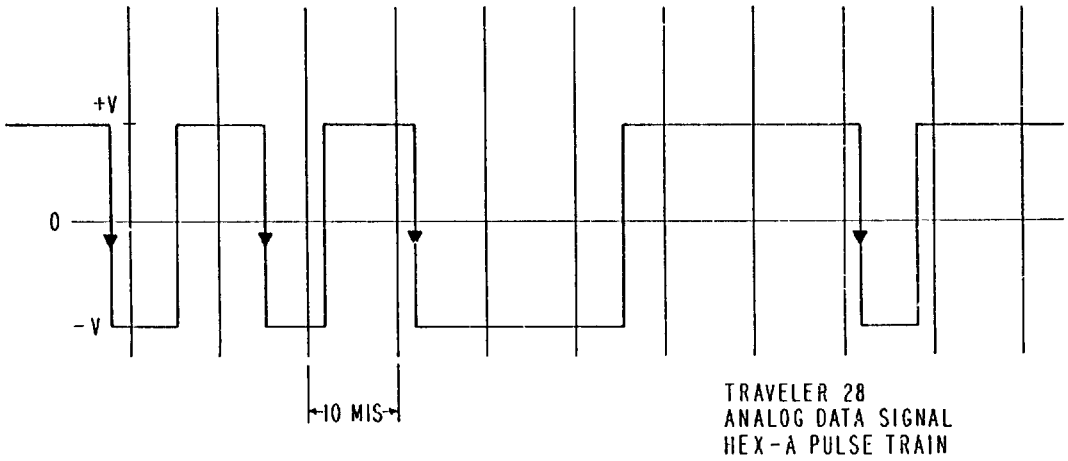
FIG. 5 is a waveform diagram of the analog data signal corresponding with a HEX-A pulse train.

In the output mode, a communications interface transfers the coded signal HEX-A over an internal bus to the serial encoder register 56 according to an external clock signal 55. Condition codes determine the transmitting rate, and the number of start, stop and parity bits required. In the example herein of HEX-coded signals, all bits are information bits. The number of start, stop and parity bits is zero. The complete analog data word HEX-A is shifted out of the serial encoder register 56 through the output conductor 48 at the given clock rate. FIG. 5 shows the form of the analog data signal which is a series of pulses of variable duration between a high value (+V) representing a logic "1" and a low value (−V) representing a logic "0".

Each dimming unit, such as DIM 1, includes a decoder 58 for receiving, decoding and comparing the remote analog signal HEX-A and comparing it with a predetermined HEX coded number in a read-only memory 60. The encoded analog signal HEX-A is input from the traveler conductor 28 through an input conductor 62 to a shift register 64.

The remote signalling and selection of each dimmer having a number corresponding to the analog signal stored in the EPROM memory 60, is made independently of phase (e.g. in FIG. 2 controller 32 and dimmer DIM 1 could be respectively powered by different phases of a two-phase distribution system) by sampling the logic value of the remote input signal in relation to a zero cross signal of line voltage of the dimmer. For this purpose, a zero cross detector 66 produces a zero cross signal 68 which is derived from zero cross transitions of the line voltage on the hot conductor 12. In accordance with one technique generally illustrated in FIGS. 5 and 6, if a high-to-low transition of the remote input signal occurs at any time during which the zero crossing signal is low, the least significant bit of the dimmer input register 64 is set to logic "1". Such transitions are shown by the arrows on the waveform of FIG. 5. If no high-to-low transition occurs during that period, that particular bit of the dimmer input register is cleared to logic "0". Each time the zero crossing signal returns to logic high, the contents of the dimmer input register are shifted. After shifting, the contents of each dimmer input register are compared bit-by-bit to HEX-coded numbers which are stored in the read-only memory 60 of the dimmer microcontroller 78. Each dimmer is enabled in response to a bit-by-bit match between the analog remote signal and a HEX-coded number stored in the memory of that dimmer. As shown in FIG. 2, DIM 1 includes a semiconductor switching device, such as a thyristor, having a gate "g" that is responsive to an enable signal from comparator 72.

Figure 4:
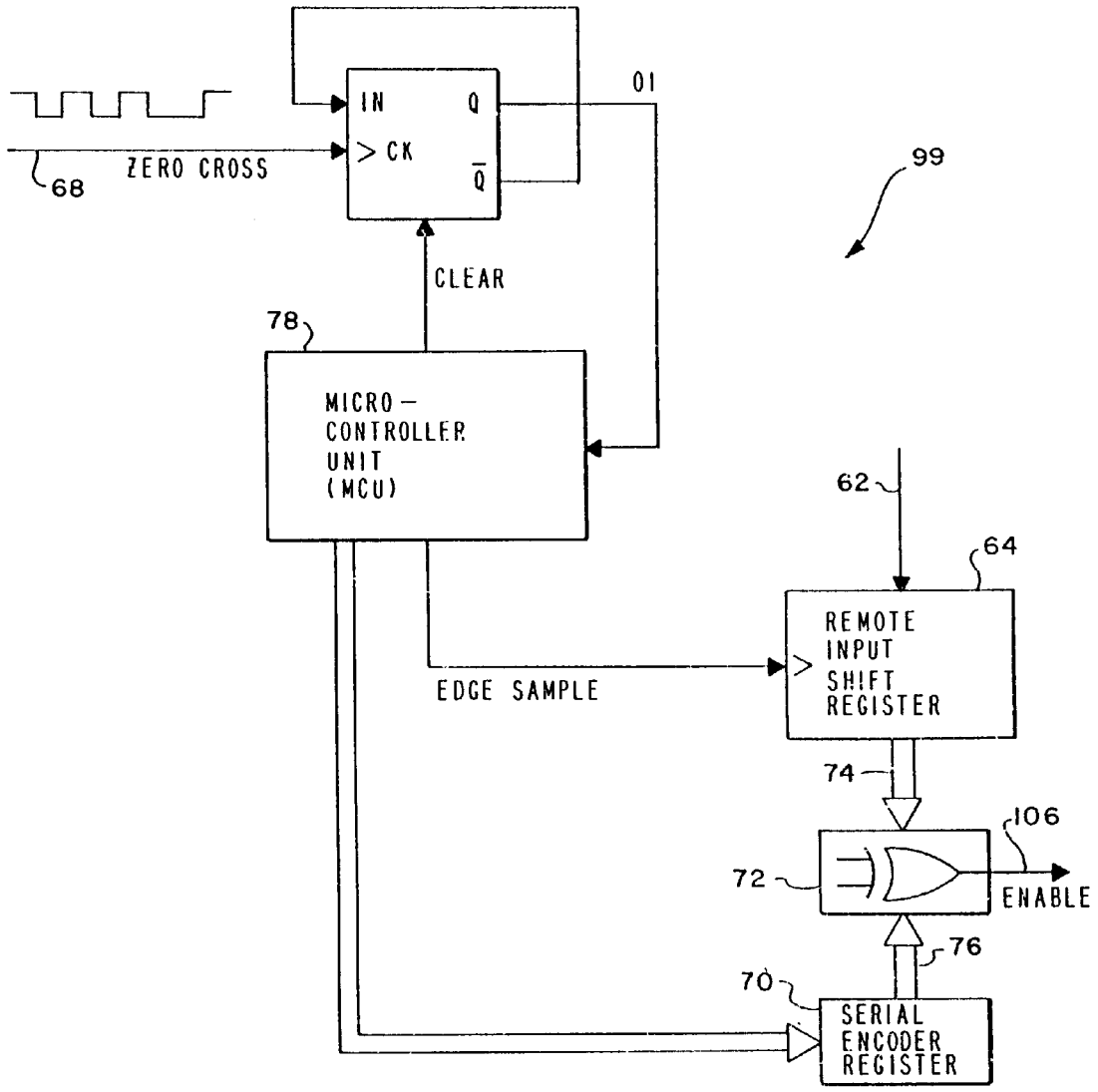
FIG. 4 is a simplied schematic block diagram of an edge detector circuit.
Figure 6:
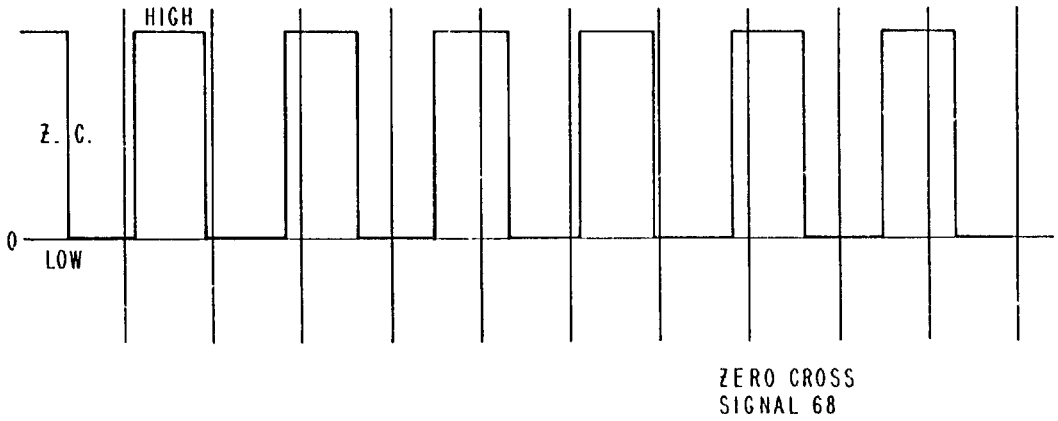
FIG. 6 is a waveform diagram of the zero cross signal appearing on the output of the zero cross detector.

Referring now to FIG. 4, FIG. 5 and FIG. 6, in response to a high-to-low transition of the zero cross signal 68, the operating program of a microcontroller 78 retrieves the binary number (HEX-A) stored in the read-only memory 60 and inputs it to a serial encoder register 70. Each time the zero crossing signal returns to logic high, the contents of the dimmer shift register 64 and the serial encoder register 70 are shifted by the output of an edge detector circuit 99, which is a portion of decoder 58, as shown in FIG. 4. The bit contents of each register are conducted to a serial bit comparator 72 through output buses 74 and 76, respectively. FIGS. 5 and 6 have like horizontal time axes.

Figure 3:
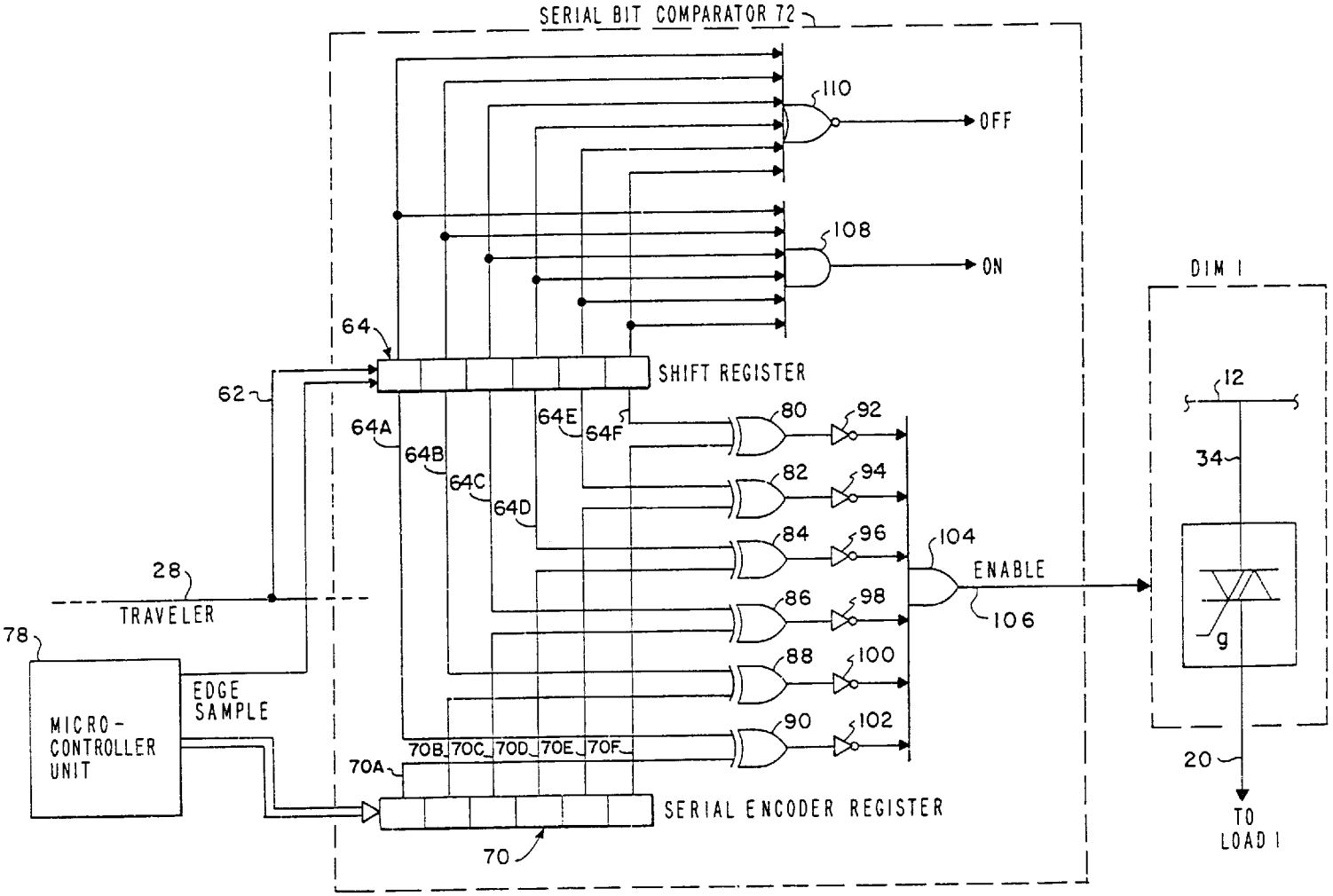
FIG. 3 is a simplified circuit diagram of the serial bit comparator of FIG. 2 and other elements of a dimmer.

Referring now to FIG. 3, the shift register 64 and the serial encoder register 70 are six bit shift registers which are designed to hold the bits of the HEX encoded data word transmitted over the traveler conductor 28. In the present example, where the HEX encoded data word contains six bits of information, the encoded analog signal on conductor 62 is fed one bit at a time into the shift register 64 until all six bits are contained in the register and are simultaneously conducted over the corresponding six output lines 64A, 64B, 64C, 64D, 64E and 64F. Likewise, the binary number HEX-A, which was previously stored in the read-only memory 60, is retrieved by a microcontroller 78 and is fed one bit at a time into the serial encoder register 70 until all six bits are contained in the register. The logic value of each bit stored in the serial encoder register 70 is conducted over output lines 70A, 70B, 70C, 70D, 70E and 70F.

Corresponding bits 64F and 70F are simultaneously applied to the inputs of an exclusive or EXOR gate 80 for comparison. Likewise, the corresponding bit pairs of the remaining bits of each register are input to exclusive OR (EXOR) gates 82, 84, 86, 88 and 90, respectively, for comparison of each bit pair. According to the logic of an exclusive OR gate, a logic zero on both inputs yields a logic zero and a logic one on both inputs yields a logic zero. If there is a logic match between corresponding bits, the output of the exclusive OR gate will be logic zero. Consequently, when there is an identical match between the remote analog data word (HEX-A) and the binary number (HEX-A) stored in the read-only memory 60, the output of each EXOR gate is logic zero.

The output of each EXOR gate is inverted by inverters 92, 94, 96, 98, 100 and 102, respectively. The inverted outputs are input to an AND gate 104 which provides a logic one enable signal 106 when each of its inputs is at logic one value. This will occur only when there is an exact match between the encoded remote signal (HEX-A) and the binary numbers stored in the read-only memory 60 (HEX-A). Under this condition, the output of each EXOR gate is logic zero, and each inverted output is logic one. In response to that condition, the AND gate 104 produces a logic one signal on the output conductor 106, and is logic zero under all other input conditions.

The ON function and the OFF function are generated in response to all data bits of the shift register 64 being at logic one value (ON function), or all data bits are logic zero (OFF function). The output of each data bit is input to an AND gate 108 which produces the ON signal in response to each input being at logic one value. Likewise, the bit contents are input to a NOR gate 110. According to the logic function of a NOR gate, a logic high output is produced in response to each input being at logic zero value. By this arrangement, the OFF signal is produced when each bit of the shift register 64 is at logic zero.

Accordingly, it will be seen that each dimmer unit can be loaded with unique encoded numbers which correspond to the encoded numbers stored in the read-only memory 52 of a remote controller or the main controller 32 in order to obtain a particular dimming level on the dimmer output. When an input switch (ON, A, B, C, D, OFF) is depressed, encoded analog signals are conducted over the traveler conductor 28 as a serial stream of analog pulses which are applied to the shift register 64 input of each dimmer unit. In this manner, each dimmer unit is enabled by the operator depressing one of the selector switches that results in the above-described match occurring.

The master controller 32 of FIGS. 1 and 2 allows selection of any scene, fade to "full" (ON) or "off" and raise/lower all dimmers together, without losing the scene or preset memories. The remote controller of FIG. 1 has selector switches that will select only the ON scene or the OFF scene and raise or/lower all channels together. For selection of a specific scene, the desired switch ON, A, B, C, D or OFF is depressed in the master controller. The current scene switch includes a light emitting diode (LED, not shown) which will glow to indicate scene status. To raise all dimmer channels together, the ON scene switch is pressed and held until the lights reach the desired intensity. When all channels are raised or lowered together, the system is in the ON condition, although each dimmer is not necessarily at its preset ON level and may, in fact, be at a lower intensity.

Figure 7:
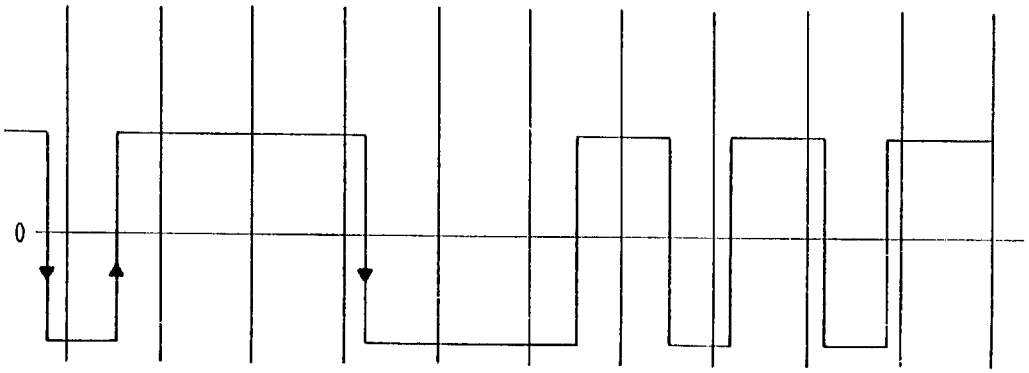
FIG. 7 and FIG. 8 are waveform diagrams corresponding with FIG. 5 and FIG. 6, which illustrate an alternative high-to-low transition detection method.
Figure 8:
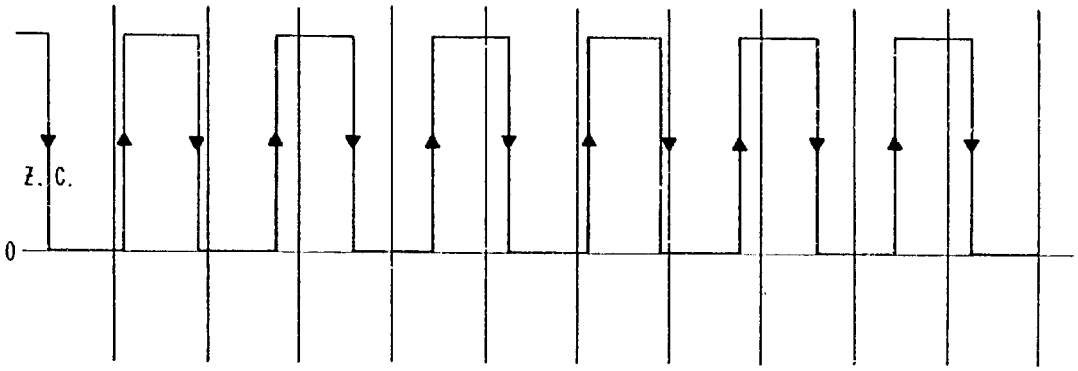

Referring now to FIG. 4, FIG. 7 and FIG. 8, in an alternative embodiment of a signal decoding technique, the microcontroller 78 of each dimmer unit includes another subroutine that performs exactly as stated above except that it waits for the zero crossing to go high before checking the remote input of the micrcontroller. This was done in case the first routine is not able to decode the remote pulse train correctly, thereby assuring more reliable operation.

According to an alternative method for decoding the four remote signals (A, B, C, D), each time a zero crossing signal makes a high to low transition, such as shown by the down directed arrows in FIG. 8, the remote input to the microcontroller is sampled to obtain the logic level. If the remote input is high, then the least significant bit (LSB) for one REMOTE INPUT register is set to logic "1". If the remote input is low when the zero crossing makes its high to low transition, then the LSB of the register is cleared to a "0". After setting or clearing this bit, the register contents are shifted left and an exclusive OR operation is performed between REMOTE INPUT register 64, and serial encoder register 70 shown in FIG. 4. The result of the exclusive OR operation is then compared with the four binary numbers for the four dimmer scenes in comparator 72. If there is a match, then the dimmer has successfully decoded a remote signal.

This embodiment includes, as compared to the embodiment of FIG. 3, an additional memory register, which is called REMOTE INPUT register 70. In register 70, the status of the remote input for the microcontroller 78 is stored based upon a low to high transition of the zero crossing signal. For example, when the zero crossing signal changes from a low logic level to a high logic level, such as shown by the up directed arrows in FIG. 8, the remote input 62 to the decoder 58 is read to check its logic level. If it is high, then the least significant bit of serial encoder register 70 is set to a "1". If it is low, then the LSB of the remote serial encoder register 70 is cleared to a zero. After setting or clearing this bit, the register contents are shifted left.

Figure 9:
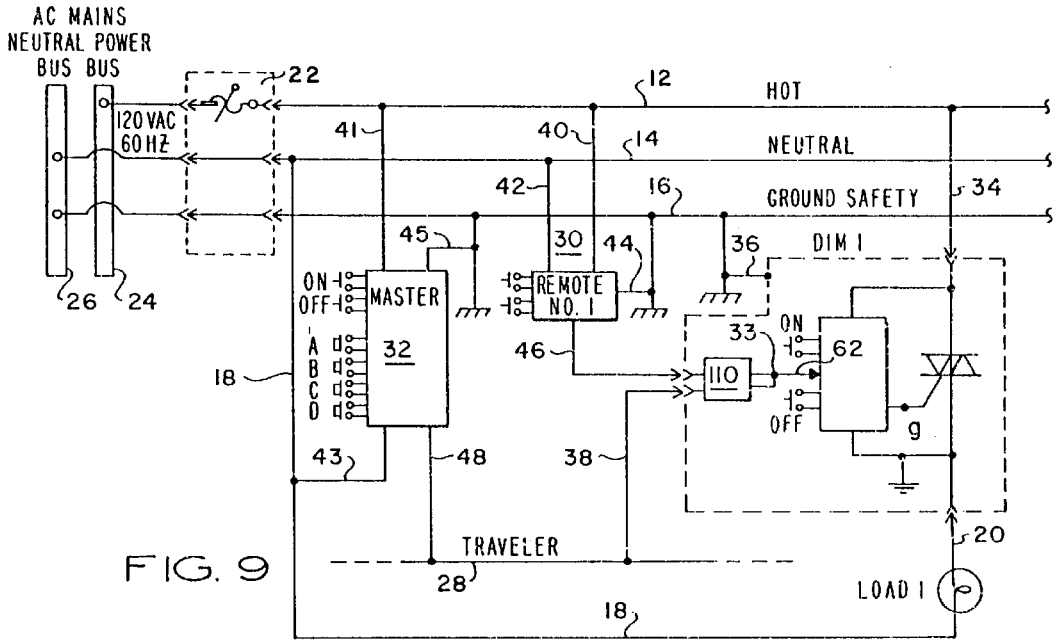
FIG. 9 is a block schematic diagram of a lighting and dimming circuit which includes local and network remote controllers; and, FIG. 10 is the low pass attenuator circuit shown in FIG. 9.
Figure 10:
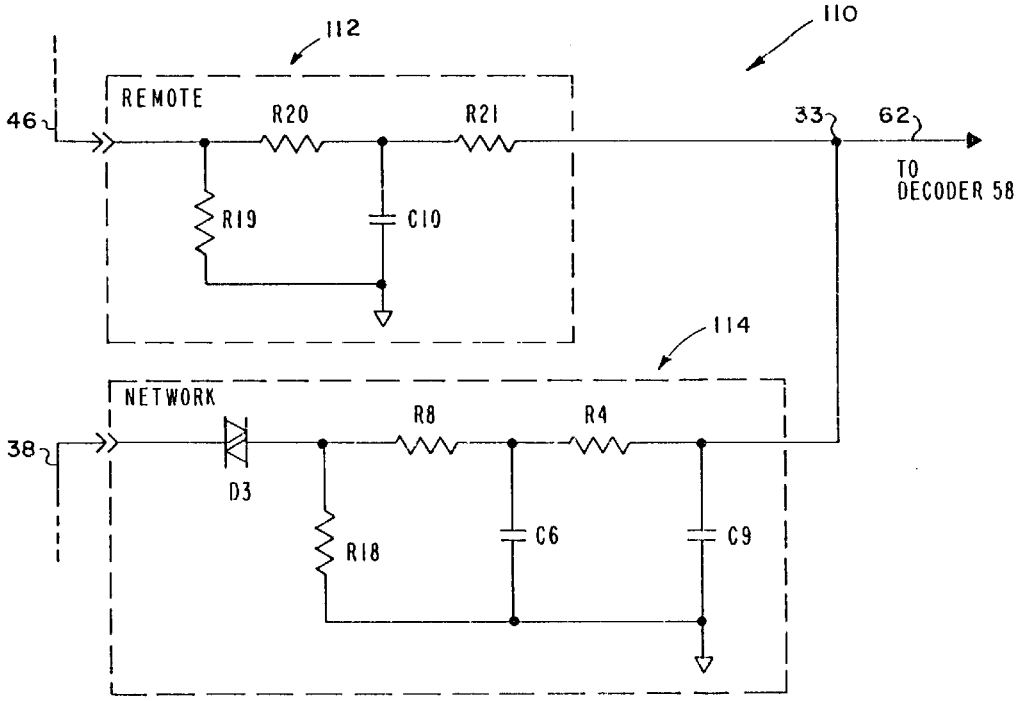

Referring now to FIG. 9 and FIG. 10, a low pass attenuator circuit 110 is interposed between the remote and master controllers 30 and 32 dimmer DIM 1. The attenuator circuit 110 permits a single remote controller, for example remote controller 30, to change a single dimming station, for example DIM 1, without affecting the intensity setting of any of the other dimmers which are connected to the network traveller conductor 28. Preferably, the attenuator circuit 110 provides attenuation in a ratio of about 20:1. The attenuator circuit 110 includes a low pass filter 112 connected in series with the local remote controller 30 on line 46 and input node 33 to decoder 58. In this example, low pass filter 112 includes series resistors R20 and R21 with resistor R19 and capacitor C10 connect to respective terminals of resistor R20; R19 and C10 have other terminals that are grounded. The network traveller 28 is decoupled with respect to the input terminal or node 33 of dimmer DIM 1 by a circuit portion 114 which is connected in series electrical circuit relation between traveler 38 and input node 33. In circuit portion 114, a diac diode D3 presents a high impedance to the flow of current from the input node 33 through the network remote controller input terminal from conductor 38. Circuit portion 114 also has a low pass filter comprising, in this example, series resistors R8 and R4 with resistor R18, capacitor C6 and capacitor C9 each having a terminal connected respectively to a first terminal of R8, a second terminal of R8, and the side of R4 connected to the input node 33. Second terminals of R18, C6, and C9 are grounded.

Although the present invention and its advantages have been described in detail, it should be understood that various changes, substitutions and alterations may be made herein without departing from the spirit and scope of the present invention as defined by the appended claims.

What is claimed is:

1. A system for selectively enabling one or more lighting levels of a dimmer group including a plurality of programmable dimmers respectively controlling a plurality of lighting loads comprising, in combination:

a master controller including means for generating a first set of one or more predetermined analog data signals corresponding to one or more predetermined lighting levels;

a remote controller including means for generating a second set of one or more predetermined analog data signals corresponding to said predetermined lighting levels;

a plurality of programmable dimmers each including receiver means for translating said analog data signals into one or more binary data signals and comparing each of the binary data signals with one or more of the predetermined binary numbers;

means coupled to the receiver means for detecting a bit-by-bit match between one of the binary data signals and one of the predetermined binary numbers;

means coupled to the means for detecting for producing an enable signal in response to a bit-by-bit match between one of the binary data signals and one of the predetermined binary numbers;

an input circuit including a first input terminal coupled to the master controller that is arranged to supply analog data signals to the programmable dimmers and a second input terminal for receiving a control signal from the remote controller that is arranged to supply analog data signals to a selected programmable dimmer of said dimmer group;

the input circuit including a first subcircuit portion coupled between the master controller and an input node;

the input circuit including a second subcircuit portion coupled between the remote controller and the input node; and, the first and second subcircuit portions being arranged to allow control signals from the remote controller to be received at the input node without affecting any other programmable dimmers to which the master controller is coupled.

2. A system as defined in claim 1, including:

a common bus conductor for conducting the analog data signals from the signal generating means to the receiver means.

3. A system as defined in claim 1, wherein said signal generating means comprises a read-only memory for storing binary data signals, each of said binary data signals being representative of a particular lighting level.

4. A system as defined in claim 3, wherein said signal generating means further comprises a register for holding one of said binary data signals retrieved from said memory means, and means for transferring one of said binary data signals from said register to the receiver means.

5. A system in accordance with claim 1 wherein:

said first subcircuit portion comprises an attenuator circuit including a first low pass filter; and, said second subcircuit portion comprises a second low pass filter connected in series with a semiconductor device presenting a high impedance for blocking control signals received at the input node from the first subcircuit portion from being received at the second input terminal.

6. Signal decoder apparatus, suitable for use in a programmable device such as a lighting dimmer, that can be controlled from a location remote from the programmable device comprising:

an input node for receiving control data;

input data register means coupled to the input node;

a memory for storing a number representing a predetermined operating condition for the programmable device;

a microcontroller, coupled to the memory, for containing an operating program to retrieve the stored number from the memory;

a stored data register coupled to the microcontroller for receiving a signal from the microcontroller representing the stored number;

a comparator coupled to the input data register means and to the stored data register for receiving and comparing the control signal from the input data register means with the stored number signal from the stored data register and for producing an output enable signal in response to a match between the compared signals;

an input circuit having an output terminal coupled to said input node;

the input circuit having a first input terminal for receiving a control signal from a first external controller that is arranged to supply control signals to the instant programmable device and a second input terminal for receiving a control signal from a second external controller that is arranged to supply control signals to a plurality of programmable devices in addition to the instant programmable device;

the input circuit including a first subcircuit portion coupled between the first input terminal and the input nodes, and a second subcircuit portion coupled between the second input terminal and the input node; and, the first and second subcircuit portions being arranged to allow control signals from the first external controller to be received at the input node without affecting any other programmable devices to which the second external controller is coupled.

7. Signal decoder apparatus in accordance with claim 6 wherein:

said first subcircuit portion comprises an attenuator circuit including a first low pass filter; and;

said second subcircuit portion comprises a second low pass filter in series with a semiconductor device presenting a high impedance for blocking control signals received at the input node from the first subcircuit portion from being received at the second input terminal.

8. A light dimming system comprising:

one or more programmable dimmer units;

a master controller and one or more remote controllers coupled to the one or more programmable dimmer units, each of the controllers and each of the dimmer units having a power supply for connection to power conductors supplying AC line voltage which, for the respective power supplies, are either the same phase or different phases;

each of the controllers comprising an information storage and retrieval system capable of storing data corresponding to a predetermined number of distinct scenes for the dimmers for the system, wherein a scene prescribes a predetermined light intensity condition for one or more lighting loads associated with one or more of the dimmers;

means for initiating commands to the information storage and retrieval system;

the information storage and retrieval system comprising signal operating means that, in response to the commands, produces a control data signal that is uniquely related to one scene;

each of the programmable dimmer units comprising a signal decoder to receive control data signals from the controllers and to determine the applicability of one of the received control data signals to the individual dimmer unit and each dimmer unit further comprising a switching device for receiving a firing signal from the signal decoder of the dimmer unit when one of the received control data signals is determined to be applicable;

the controllers and dimmer units being configured so that the received control data signals are in a form such that they can be transmitted from a single controller to a plurality of the dimmer units by a signal traveler conductor and the received control data signals require no accompanying data bits for identifying the start or termination of one of the received control data signals, an input circuit including a first input terminal coupled to the master controller that is arranged to supply analog data signals to the programmable dimmers and a second input terminal for receiving one of the control data signals from one of the remote controllers that is arranged to supply analog data signals to a selected programmable dimmer of the dimmer units;

the input circuit including a first subcircuit portion coupled between the master controller and an input node;

the input circuit including a second subcircuit portion coupled between said one remote controller and the input node; and, the first and second subcircuit portions being arranged to allow control signals from one of said remote controllers to be received at the input node without affecting any other programmable dimmers to which the master controller is coupled.

9. A light dimming system in accordance with claim 8 wherein:

said first subcircuit portion comprises an attenuator circuit including a first low pass filter; and, said second subcircuit portion comprises a second low pass filter connected in series with a semiconductor device presenting a high impedance for blocking control signals received at the input node from the first subcircuit portion from being received at the second input terminal.

* * * * *